United States Patent [19]

Brooks

[11] 4,230,206

[45] Oct. 28, 1980

[54] TRANSISTORIZED ELEVATOR CONTROL BUTTON

[75] Inventor: Kenneth R. Brooks, Brooklyn, N.Y.

[73] Assignee: Otis Elevator Company, Hartford, Conn.

[21] Appl. No.: 952,223

[22] Filed: Oct. 17, 1978

[51] Int. Cl.[3] ..... B66B 1/46

[52] U.S. Cl. ..... 187/29 R; 340/19 R

[58] Field of Search ..... 187/29; 340/19

[56] References Cited

U.S. PATENT DOCUMENTS

| | | | |
|---|---|---|---|
| 3,506,096 | 4/1970 | Robaszkiewicz | 187/29 |
| 3,774,728 | 11/1973 | Metzler et al. | 187/29 |
| 4,120,381 | 10/1978 | Otto et al. | 187/29 |
| 4,124,102 | 11/1978 | Doane et al. | 187/29 |

*Primary Examiner*—Gene Z. Rubinson
*Assistant Examiner*—W. E. Duncanson, Jr.
*Attorney, Agent, or Firm*—R. E. Greenstien

[57] ABSTRACT

A switch is closed to generate a short duration pulse. The pulse activates a semiconductor switch which powers an indicator lamp and generates a D.C. control signal on a single conductor. A latching unit responds to the D.C. signal on the conductor to latch the switch in the activated state. A reset signal consisting of half wave pulses is transmitted over the conductor. These pulses charge a capacitor coupled to the switch input to substantially the peak voltage of the half wave pulses, which deactivates the switch. The capacitor holds a voltage of sufficient level to maintain the switch in the deactivated state until the latch unit is deactivated when transmission of the reset signal stops.

10 Claims, 6 Drawing Figures

TRANSISTORIZED ELEVATOR CONTROL BUTTON

BACKGROUND OF THE INVENTION

This invention relates to elevator controls and, in particular, to the car and hall call buttons activated for requesting elevator service.

The contactless touch button, consisting of a cold cathode gas tube, is a popular and widely used type of button, particularly because it has no moving parts. It is the subject of U.S. Pat. Nos. 2,525,767, 2,525,768 and 2,525,769. The button is activated in response to the capacitance between a metallic coating on the cold cathode tube and the user's finger. In installations using this button, a D.C. voltage is applied across the anode and cathode while, at the same time, it is floated on an A.C. voltage to enhance the capacitive coupling response needed to fire the tube. Typically, the D.C. voltage is about 135 volts and the A.C. float voltage is about 200 volts r.m.s. When activated, the tube conducts a D.C. current, which is used to generate a signal to activate the elevator controls located in a remote control room, while at the same time, it glows to provide a visual indication of a service request.

When the requested elevator service is supplied, an A.C. signal is transmitted to the button and where it is used to bias the tube into its nonconductive state. The tube thereupon ceases to glow, indicating that the requested service has been supplied.

Power for the tube is derived from the control room and is carried over three conductors. One conductor carries the positive D.C. voltage; a second provides a D.C. return and the third carries the reset signal and the D.C. control signal. In installations having several call buttons on a floor or in a car, known as multiriser systems, the buttons are connected in parallel so that activation of one button will activate the others.

In certain applications there is a need, however, to replace the touch type button with a mechanical type. It is desired, however, that the replacement use the existing wiring and, naturally, require little if any modification to the power supplies in the control room. This "retrofit" unit also needs to provide a visual indication of a request and also have about the same performance characteristics as the gas tube unit.

There are two particularly important constraints imposed upon the retrofit unit. First, it should generate essentially the same D.C. control signal, when activated, and respond to the same type of reset signal, so that modifications are not necessary to the control circuitry. Second, it should be usable in the multiriser systems, and provide the same performance in those installations.

SUMMARY OF THE INVENTION

Thus an object of the present invention is to provide a retrofit elevator control button having the same performance characteristics as the cold gas tube type button.

A related object is to provide a retrofit, mechanical type button which requires little if any modification to the existing circuitry and power systems, and, in particular, which is compatible with the existing reset and control signals.

In accordance with the present invention, a mechanical switch is connected to the existing D.C. power supply lines and is activated to provide a momentary pulse to a solid-state switch which is then placed in a high conductance state. The solid-state switch includes an output transistor which is coupled to the existing positive voltage and driven into saturation. The transistor provides connection to the existing reset and signal line and when driven into saturation applies substantially the same D.C. control signal to the reset line as the gas tube. The output transistor, thus, essentially duplicates the active state condition of the replaced gas tube. The D.C. signal on the reset and signal line is used to activate a solid-state latch unit which provides a signal to the switch input causing it to latch in this activated state. Once activated, the output transistor in the solid-state switch applies substantially the supply D.C. voltage to at least one neon indicator light, causing it to glow.

A reset signal, which consists of half wave rectified pulses, is applied to the reset-signal line. A capacitor is coupled to the input of the solid-state switch, and charges to substantially the peak level of the pulses causing the switch to deactivate. Due to its polarity, the reset signal tends to maintain the latch unit in a condition supplying an input signal to the solid-state switch that would hold the switch in the activated state, after each pulse. The capacitor prevents this, however, by maintaining the deactivating voltage on the switch input until the latch also goes off when the pulse drops below the voltage needed to turn it on.

DETAILED DESCRIPTION

Figure 1:
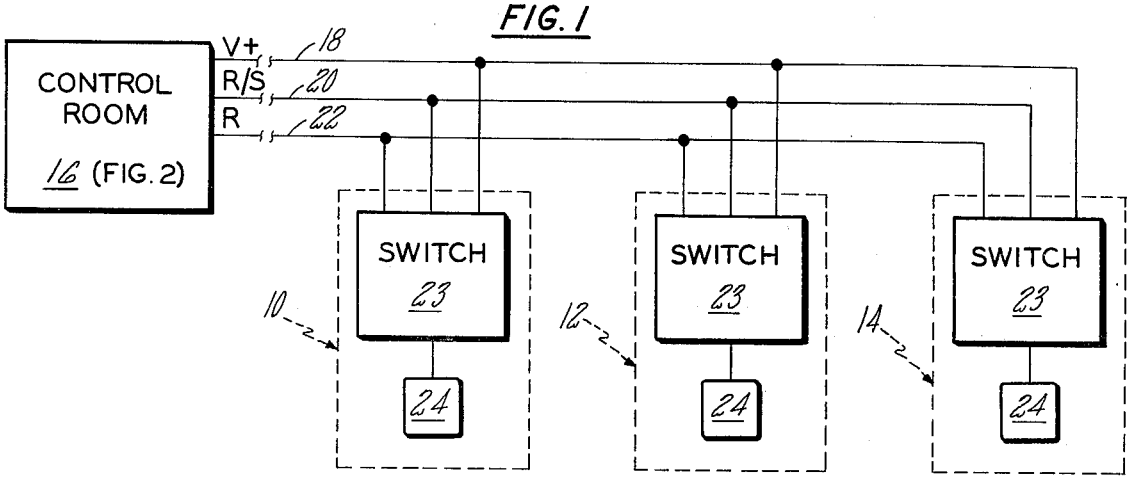
FIG. 1 is a block diagram of a multiriser elevator button control, showing the connection of three buttons to the existing control room over the existing lines.

FIG. 1 is a block diagram of a three-riser installation. Three buttons 10, 12, 14 are connected to the control room 16 over a V+ line 18, an R/S line 20 and an R line 22. The three buttons 10, 12, 14 are identical and each can be seen to include a switch 23 and an indicator 24. The V+ line 18 provides the positive voltage supply to the switch 23 in each button; the R line 22 provides a return for the V+ line 18; and the R/S line 20 provides the signal path for the reset signal transmitted from the control room 16 and the D.C. signal produced when any one of the buttons is activated upon a service or call request.

The V+ line 18, R/S line 20, R line 22 and the control room 16 represent the preexisting elevator equipment associated with the replaced gas tube button. The buttons 10, 12, 14 connect directly to lines 18, 20 and 22.

Figure 2:
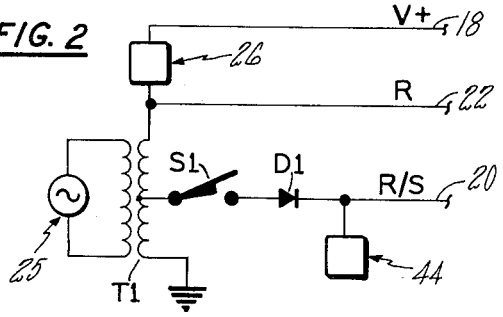
FIG. 2 is a simplified schematic diagram of the control room circuitry.

FIG. 2 is a comparatively simplified schematic diagram of the power supply for the buttons contained in the control room 16. A transformer T1 is powered from an A.C. source 25 and provides approximately 200 v.a.c. float to the D.C. power supply 26 connected to the V+ line 18 and the R line 22. This 200 volt float, as mentioned earlier, enhances operation of the gas tube type switch. The transformer T1 is tapped so as to produce a smaller A.C. voltage which is supplied to the diode D1. The switch S1, typically a suitable relay contact, provides a controlled connection between the cathode of the diode D1 and the R/S line 20 and is activated to produce the half wave reset signal of FIG. 6 transmitted over the R/S line to the buttons 10, 12, 14. The unit 44 generally depicts the control circuit connected to the R/S line which is responsive to the D.C. signal placed on the line when a service request is made. The details of the control unit 44 are not germane to an understanding of the present invention and are not described.

Figure 3:
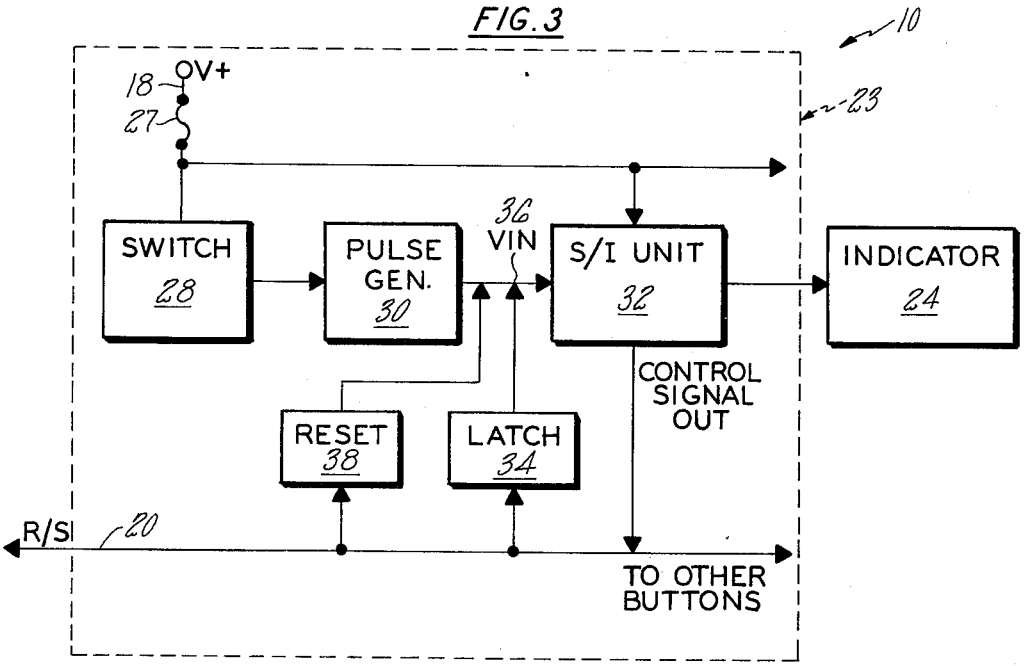
FIG. 3 is a block diagram of a button embracing the present invention.

FIG. 3 is a block diagram button 10, which is identical to the buttons 12, 14 of FIG. 1. The V+ line 18 is connected through an optional temperature responsive fuse 27 to a switch unit 28. This switch is mechanically actuated by a caller and causes pulse generator 30 to generate a single short pulse which is supplied to the input 36 of the signal and indicator S/I unit 32. The S/I unit is connected to the V+ line 18 through the fuse 27 and when activated supplies power to the indicator 24, which as set forth below, consists of an illuminating device, such as a neon bulb. When the S/I unit 32 is activated it also produces a D.C. signal which is applied to the R/S line 20. The latch unit 34 is connected to the R/S line and in response to the D.C. signal applies a signal to the input 36 of the S/I unit 32 so as to latch it in the activated state with the indicator 24 remaining in an activated condition and the D.C. signal continuously applied to the R/S line and the latch 34.

The previously mentioned optional fuse 27 would be included in the hall buttons so that in the event of a fire, all power to the buttons would be removed thereby preventing unintended activation of the buttons, which could undesirably result in calling an elevator to a floor where a fire is present.

Figure 6:
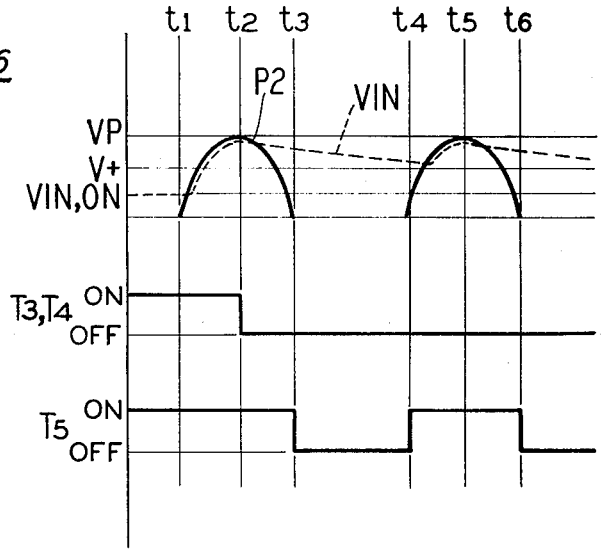
FIG. 6 is a common time base diagram of the waveforms for the reset signal, and the input voltage to the solid-state switch, and a plot of the activation states for the latch and solid-state switch.

The half wave rectified pulses, shown in FIG. 6, are transmitted on the R/S line to reset the button. The pulses are applied to the reset unit 38 which applies an additional signal to the S/I input 36 that negates the output from the latch 34 so as to deactivate the S/I unit. This removes the D.C. signal on the R/S line 20 and simultaneously deactivates indicator 24.

In the anticipated retrofit application for existing touch type buttons, the half wave pulses are of the same polarity as the D.C. signal on the R/S line and therefore they tend to reinforce latch 34 in a condition at which it continues to apply an activating signal to input 36. That could activate the S/I unit as the output of the reset unit 38 decreases each time the reset pulses go to zero, thereby preventing deactivation of the button by the reset signal. However, as outlined in greater detail after, the reset unit holds the deactivating voltage for substantially the complete duration of at least one pulse which allows the output of the latch unit 34 to go off before a pulse goes to zero, thereby assuring that the signal indicator unit 32 is completely deactivated by the reset signal.

Figure 4:
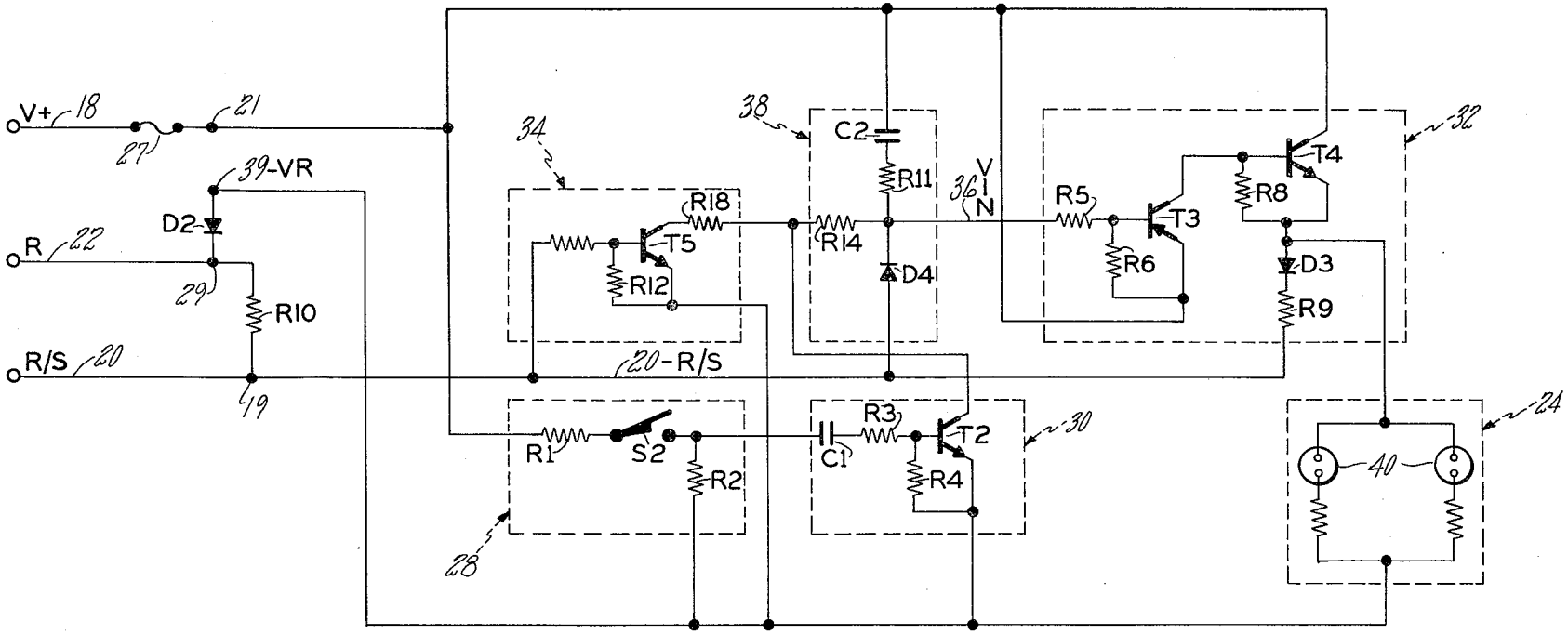
FIG. 4 is a schematic of the button circuit of FIG. 3.

FIG. 4 is a schematic of the button 10. The incoming R/S line 20 is connected to the R/S terminal 19 included in the button. Similarly, the V+ line 18 is connected to the included V+ terminal 21 and the R line 22 connects to the R terminal 29. In addition, a VR terminal 39 is provided and is connected to the R line through the diode D2. The VR terminal 39 provides the D.C. voltage return from the V+ terminal 21 in the button. All circuit connections in the button to the R/S line 20, R line 22 and V+ line 18 are made to these terminals 19, 21, 29, which enables connection of the button to the existing lines by simply connecting each line to its corresponding terminal.

The switch unit 28 includes resistors R1 and R2 and a mechanical type switch S2. When switch S2 is closed, the circuit is completed from the V+ terminal 21 to the VR terminal through resistors R1 and R2, thereby producing a voltage across resistor R2. This voltage is applied to the input of pulse generator 30 through a capacitor C1 and instantaneously passes through capacitor C1 and appears across resistors R3 and R4. Capacitor C1 and resistors R3 and R4 function as a differentiator circuit in producing a pulse P1 across resistor R3 having the characteristics shown in the waveform of FIG. 5. The time duration of pulse P1 is determined by the time constant associated with capacitor C1 and resistors R3 and R4. The specific operational parameters for determining a time constant, of course, depends on the particular installation.

Pulse P1 is applied across the base of the transistor T2 which is thereby driven into an active state of conduction. The resulting collector current in transistor T2 produces a voltage drop across the resistor R6 in the S/I unit 32 that connects the base and emitter of transistor T3. This voltage drop, when exceeding at least 0.6 volts, turns transistor T3 on and its resulting collector current produces a voltage drop across the resistor R8 that connects the base and emitter of the transistor T4. The collector of the transistor T4 is connected to the V+ terminal 21. The transistor T4 is driven into near saturation by transistor T3 and, as a result, the emitter of the transistor T4 is substantially at its collector voltage, V+. The emitter of the transistor T4 is connected to the indicator unit 24, which as shown, consists of two neon lights 40. These neon lights require at least 120 volts to glow and, consequently, if the V+ terminal is about 135 volts, when transistor T4 is near saturation, at least 120 volts is applied across the lamps 40, thereby ensuring their activation.

When transistor T4 is in the conductive state, its emitter current flows through a diode D3 and a resistor R9 that connects the emitter of transistor T4 to the R/S terminal 19. A resistor R10 across the R/S and R terminals 19, 29 represents an external load in the machine room or button fixture and the emitter current flows through the resistor 10 from the R/S terminal to produce a D.C. voltage on the R/S line 19. The value of R10 determines the level of the D.C. voltage appearing on the R/S line and this D.C. voltage provides the required call signal for unit 44 in the control room (FIG. 2). This D.C. voltage, at the same time, biases a transistor T5 in latch unit 34 into conduction by establishing a suitable voltage across a resistor R12 that connects its base and emitter. The resulting current in transistor T5 flows from the V+ terminal 21 through the resistor R6. This latches transistor T3 on to hold transistor T4 in its activated near saturation state, with lamps 40 glowing and the D.C. voltage on the R/S line 19 continuously being present. This constitutes the activated state for latch 34 and S/I unit 32.

The reset unit 38 contains a storage capacitor C2 having one electrode connected to the V+ terminal and its other terminal connected to the input 36 of S/I unit 32 through a resistor R11. A diode D4 connects the R/S terminal and the input 36. Prior to activation of switch S2, capacitor C2 has substantially no voltage across it and therefore input 36 is substantially at the voltage of the V+ terminal (V+), which keeps transistor T3 off. When switch S2 is closed, however, it is necessary to bring the input 36 down to a voltage low enough so as to forward bias the emitter base junction of transistor T3 to turn it on. The specific level required, of course, depends on the particular level of the V+ terminal and the required operating parameters for the semiconductors used, although, in general, the base of transistor T3 should be at least 0.6 volts negative with respect to the emitter to assure full turn on of transistor T3. It should be noted, however, that since the voltage on capacitor C2 cannot instantly change, there will be a time lag from the time t2 is rendered conductive until input 36 drops below the level allowing transistor T3 to turn on. It is therefore necessary that the time constant associated with the differentiator in the pulse generator 30 (capacitor C1, resistors R3 and R4) be long enough so that transistor T2 remains on long enough for input 36 to drop at least 0.6 volts below V+. A table is set forth in a latter portion of this description showing the respective resistor and capacitor levels for a specific retrofit installation utilizing a 135 volt supply and neon lamps 40 in accordance with these guidelines.

As mentioned previously, when the switch S1 in control room 16 is closed (FIG. 2), the reset signal is generated on the R/S line 20. This signal is supplied from diode D1 and consists of the positive half wave pulses P2, as shown in FIG. 6. If the peak value VP of each pulse P2 is greater than the voltage level of input 36 when transistor T5 is on, then diode D4 will conduct, and, as a result, the capacitor C2 will charge towards VP at a rate determined by its time constant. If VP is at least equal to V+, D4 will conduct and when the input 36 reaches V+, transistor T3 will be turned off because its base-emitter junction will no longer be forward biased. However, to assure that the transistor is turned off, the peak level VP of the pulses should be somewhat greater than V+ so that the voltage level on capacitor C2 will produce a significant back bias upon the base-emitter junction of transistor T3.

An important aspect to be noted is that the positive reset pulses P2, although being of the polarity and magnitude which turns transistor T3 and T4 off, nonetheless are of a polarity that drives transistor T5 into further conduction, even with transistor T4 off. Consequently, capacitor C2 must hold VIN at input 36 at or above the turn off voltage of transistor T3 until transistor T5 goes completely off after the reset P2 pulse ceases at the end of the half cycle.

The diode D4 couples the reset signal to the input 36 and capacitor C2 while effectively creating an open circuit from the base of transistor T3 through the R/S line 20 and resistor R10 to the R line 22. Without it, the button would permanently latch up as soon as power is supplied on the V+ line. The diode D3 protects transistor T4 and the balance of the S/I unit 32 from the positive pulses P2 on the R/S line 19.

Referring to FIG. 1 and FIG. 4, in a multiriser system, activation of any one button 10, 12, 14 will activate the remaining buttons also connected to the same R/S line. This occurs because the D.C. voltage placed on the R/S line 20, when a button is actuated, will activate the transistor T5 in each unit and discharge the related capacitor C2, whereupon the related transistors T3 and T4 are driven into conduction and the neon lamps 40 are activated. In the multiriser system, the resistor R10 associated with each button 10, 12, 14 is in parallel with the corresponding associated resistor for the other buttons. Thus, when the one button is actuated, the current from the transistor T4 in that button flows essentially through a resistance equal to one-third of resistor R10 and, therefore, the D.C. level on the R/S line will be one-third of the required level. However, after a brief interval of time, determined essentially by the time constant of capacitor C2, the remaining buttons will become activated. Thus, with all the buttons on, the net current is three times higher which brings the voltage on the R/S line 20 up to the normal, required level. The time interval for this duration is virtually imperceptible, and of little or no significance to the operation of the elevator system. In this way, the button of the present invention performs the same as the gas tube of the prior art. Moreover, in multiriser systems, the R/S line is given identical use: it provides interconnection between corresponding buttons so that activation of any one simultaneously activates the others causing their respective indicators to be activated; and it provides a common reset linkage for related buttons.

As set forth earlier, the present invention has particular utility in a retrofit installation for the touch type gas tube elevator buttons. In these installations there is usually a 135 volt V+ supply which floats on a 200 volt A.C. supply. Referring to FIG. 2, in that instance the V+ line 18 would be at 135 volts and both the V+ line and R line 22 would float on a 200 volt A.C. level. In these installations the R/S line is usually taken off transformer T1 so as to produce a 100 volt half wave pulse on the output of diode D1. However, to assure that transistor T3 is turned off by the reset signal, transformer T1 should be tapped so pulses P2 have a peak value equal to approximately 160 volts. With the input 36 at this voltage level T3 will be heavily back biased. The following table represents the resistor and capacitor values considered important to the operation of the retrofit button in a specific installation of this type.

| | | | |
|---|---|---|---|
| C1 = .15 mmf | R3 = 330 k | R8 = 2.2 k | R14 = 100 k |
| C2 = .39 mmf | R4 = 12 k | R9 = 3.9 k | R18 = 100 k |
| R1 = 10 k | R5 = 130 k | R10 = 3.3 k | V+ = 135 v.d.c. |
| R2 = 560 k | R6 = 4.3 k | R11 = 470 | P2 = 160 peak, 60 Hz. |

Utilizing these values, the time constant for the capacitor C1 is determined ostensively by the product of the value of the capacitor and the resistor R3. The resistor R4 is shunted by the transistor T2 when the transistor conducts. The resistor R1 is substantially smaller than resistor R3. Consequently, for present purposes, the resistors R1 and R4 can be discounted in the computation of the time constant, which is approximately 50 m.s.

The time constant for the capacitor C1 is determined under two distinct operating conditions. The first condition is when the capacitor is forced to a voltage less than V+ so as to turn transistor T3 on when transistor T2 is turned on by the switch S2. Under this condition, the time constant is determined essentially by the product of the value of the capacitor C2 and the combined, effective resistance of the resistor R1 plus the parallel resistance of the resistors R5 and R14. The resulting time constant under this condition is approximately 23 m.s. Under the second condition, the transistor T2 is off; the reset signal is applied to R/S line and the capacitor C2 is charged towards the peak level of the reset pulses. The capacitor C2 is charged, during this sequence, through the resistor R11 and consequently the time constant is approximately 0.2 m.s. Since the half wave pulses that comprise the reset signal occur at a frequency of 60 Hz., each pulse is approximately 8 m.s. long. Therefore the voltage on the capacitor C2 follows the pulses. After the capacitor C2 has charged to the peak level of the reset pulse, the discharge path for the capacitor is quite different and comparatively complex, since, at that time, the transistor T5 is still conductive, and remains so, until the reset pulses go substantially to zero. The discharge path is ostensively through the resistors R5, R14 and R18 and the resulting time constant, using known circuit analysis techniques, is approximately 32 m.s.

The significance of these time constants is simply to demonstrate how the capacitor C2 holds a voltage greater than V+ following the peak level of the reset pulse and thereby holds the input voltage VIN at input 36, above V+ so as to hold the transistors T3 and T4 in an off condition while the pulse goes to zero, which also turns transistor T5 off.

The time constant associated with the capacitor C1 demonstrates how the transistor T2 stays on sufficiently long to allow the voltage on the capacitor C2 to drop below the level of V+ so as to allow the VIN, at input 36, to drop below this level to turn the transistor T3 on. In particular, when the switch S2 is closed, the instantaneous voltage between the terminal 39 and the junction of capacitor C1 and resistor R3 is at least 110 volts. Since the required voltage at this junction to cause the transistor T2 to conduct is no more than 30 volts, the transistor T2 actually remains in a conductive state for more than one time constant of the capacitor C1, until this junction voltage decays to less than 30 volts. This assures that the requisite interrelation between the conductive state of the transistor T2 and the charging of the capacitor C2 is satisfied.

Figure 5:
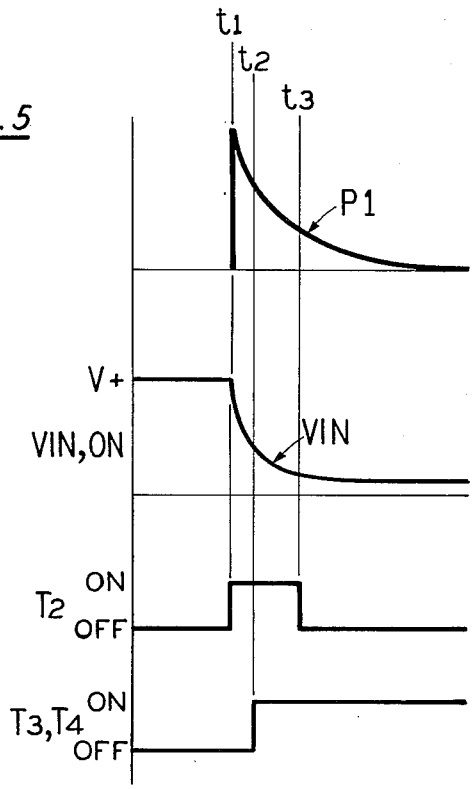
FIG. 5 is a common time base diagram of the waveforms for the output pulse from the mechanical switch in the button; the resulting input voltage that activates the solid-state switch and the corresponding ON-OFF states for the transistors in the mechanical and solid-state switches.

Referring to FIG. 5, at time t1, the switch S2 is momentarily closed, producing the pulse P1. As a result, the transistor T2 is turned on at time t1. In the manner set forth previously, the voltage VIN at input 36 drops from V+ to VIN, ON, at the time t2. At that time both of the transistors T3 and T4 are turned on. The transistor T2 remains on until the time t3. Although the time constant associated with the pulse P1 is shown to be considerably longer than the time constant associated with VIN, it is important to realize that the time constant together with the peak level of the pulse P1 assures that the transistor T2 will remain in a conductive state for a period of time greater than is needed for VIN to drop from V+ to VIN, ON. Simply having a longer time constant would not suffice if the peak level was close to the turn on voltage for transistor T2, because the pulse P1 would quickly drop below the voltage turning transistor T2 on and thereby never allow VIN to drop to VIN-ON. Likewise, even if the peak voltage of the pulse P1 is much greater than the voltage needed to turn the transistor T2 on, an extremely short time constant associated with the capacitor C1 will allow the pulse to drop below the activating level before VIN reaches VIN-ON. Thus proper operation requires consideration of both of these parameters. The foregoing selected values meet these requirements.

Referring now to FIG. 6, the reset pulse P2 is applied at time t1 and as a result the voltage VIN, at input terminal 36, shown by the dotted line, begins to rise towards VP, the peak voltage of the pulse P2. If the time constant for the capacitor C2 is sufficiently short, as it is in the case of the previously set forth values, VIN will essentially follow the pulse P2 and reach VP at time t2. Nonetheless, for purposes of waveform clarity, a longer time constant is assumed and hence VIN does not necessarily reach VP in a single pulse, but instead charges to an intermediate voltage between V+ and VP between times t1 and t2. Following time t2, the capacitor discharges at an extremely slow rate, due to the longer discharge time constant, and as a result, at time t4 VIN is still above V+. The importance of this is that following time t2, VIN is held above V+ and in particular as long as the reset pulses P2 are applied. As a result, transistors T3 and T4 are turned off and remain off following time t2. However, because the polarity of the reset pulse P2 maintains transistor T5 on, only when the reset pulse goes substantially to zero, for example between times t3 and t4 and at an after time t6, is the transistor T5 turned off. In the case of a single reset pulse P2, it can be seen that the transistors T3, T4 and T5 are off following time t3, this being a button reset condition. However in the event of successive reset pulses, it also can be seen that at time t4 the transistor T5 is again turned on even though the transistors T3 and T4 remain off, due to the holding action of the capacitor C2. However, at time t6 the transistor T5 is again turned off, in effect repeating the previous button reset condition that occurred at the time t3. Consequently, once the transistors T3 and T4 are turned off they cannot be turned on by transistor T5 but only by actuation of the switch S2.

The foregoing is a description of the preferred embodiment of the present invention. Specific component values have been set forth where deemed appropriate to an understanding of the operation of the button embracing the invention. Nevertheless, it is anticipated that there are numerous possible modifications and variations which nevertheless embrace the full scope and spirit of the invention, and therefore the claims which follow are intended to cover all such modifications and variations.

I claim:

1. Apparatus adapted for connection to a single conductor, for generating a control signal thereon from a latched, activated state, and resetable from said state in response to a reset signal selectively applied to the conductor, said apparatus comprising, a switch selectively activated for generating the control signal upon the conductor, latch means, in circuit with the conductor and said switch, for supplying a signal to maintain said switch in said activated state in response to said control signal, said latch means characterized in that it also generates said maintaining signal in response to said reset signal, reset means for generating a signal to deactivate said switch, in response to the reset signal, as long as said latch means supplies said maintaining signal to said switch, in response to the reset signal, whereby both said switch and said latch means are returned to normally deactivated states when the reset signal is removed from said conductor.

2. The apparatus of claim 1, wherein, the reset signal comprises a train of successive pulses, and said reset means applies the pulses to an input control terminal on said switch and holds substantially the peak level of said pulses to deactivate said switch between successive pulses and for a finite interval of time after the reset signal is removed from the conductor.

3. The apparatus of claim 2, wherein, said reset means includes a capacitor for storing the peak level of said pulses.

4. The apparatus of claim 1, further comprising, a pulse generator, and a mechanical switch operated to activate said pulse generator to produce a pulse of finite duration activating said switch generating said control signal.

5. The apparatus of claim 4, wherein, said pulse generator includes a differentiator circuit, and said mechanical switch is operated to apply a D.C. voltage to said differentiator circuit.

6. The apparatus described in claim 5, further comprising, an indicator device activated and powered by said switch generating said control signal when said switch is in an activated state.

7. A solid-state switch for elevator control systems of the type including a first conductor for carrying selectively applied elevator control and switch reset signals between an elevator control center and said switch, and a second conductor supplying a direct current power to said switch from the control center, comprising, means for generating a nonrepetitive pulse, an indicator device adapted to be powered from the D.C. voltage, control signal generation means, activated by said pulse, for generating an elevator call signal on the first conductor and activating said indicator from the D.C. voltage supplied on the second conductor, latch means for maintaining activation of said generation means following said pulse in response to said call signal or the switch reset signal, and reset means for deactivating said generation means in response to the switch reset signal and for maintaining deactivation following the application of the reset signal.

8. The solid-state switch described in claim 7, wherein, said reset means generates a cutoff signal which is applied to said generation means, deactivating said generation means, in response to the application of the reset signal on the first conductor, said reset means includes means for delaying removal of said cutoff signal from said generation means following removal of the reset signal from the first conductor.

9. The solid-state switch of claim 8, wherein, said generation means includes a control terminal to which said cutoff signal is applied, and said reset means includes a capacitor which is connected to said terminal and charged to substantially the peak level of said cutoff signal during application of said cutoff signal to said terminal.

10. The solid-state switch of claim 9, wherein, said cutoff signal is a half wave pulse having a peak level greater than a minimum level required to deactivate said generation means, and said capacitor is charged to a voltage above said minimum level by said pulse and maintains a voltage of at least said minimum level for at least the duration of said pulse.

* * * * *